United States Patent [19]

McCord

[11] 4,136,874

[45] Jan. 30, 1979

[54] VERTICALLY ADJUSTABLE BOVINE ROPING PRACTICE APPARATUS

[76] Inventor: Kenneth J. McCord, 1725 W. Eva, Phoenix, Ariz. 85021

[21] Appl. No.: 824,002

[22] Filed: Aug. 12, 1977

[51] Int. Cl.[2] ..... A63K 3/00; A63B 69/00

[52] U.S. Cl. ..... 273/105.2; 273/102 S; 46/123

[58] Field of Search ..... 273/105.2, 105.6, 102 S; 119/29; 46/105, 123; 35/29 R

[56] References Cited

U.S. PATENT DOCUMENTS

| | | | |
|---|---|---|---|
| 2,022,861 | 12/1935 | Long | 46/105 |
| 2,560,657 | 7/1951 | Nogle | 35/29 R |
| 2,819,900 | 1/1958 | Brackett | 273/105.2 |
| 3,066,939 | 12/1962 | Sprout | 273/102 R |
| 3,711,098 | 1/1973 | McCord | 273/105.2 |
| 3,776,553 | 12/1973 | Kelton | 273/105.2 |
| 3,947,033 | 3/1976 | Bennett | 273/105.2 |

FOREIGN PATENT DOCUMENTS

| | | | |
|---|---|---|---|
| 71096 | 1/1893 | Fed. Rep. of Germany | 46/1 R |
| 163181 | 10/1905 | Fed. Rep. of Germany | 273/105.2 |
| 11478 of | 1911 | United Kingdom | 273/105.2 |

*Primary Examiner*—Richard C. Pinkham
*Assistant Examiner*—Lawrence E. Anderson
*Attorney, Agent, or Firm*—Henderson, Sturm, Cepican & Fix

[57] ABSTRACT

A portable, mechanical apparatus that can simulate either a running calf or a running steer for the purposes of roping exercises by changing the body height and position to resemble either a calf or a steer. The apparatus further including a ground engaging element and a release system that accomodates the roping techniques of both calf roping and steer roping which is easily reconnected to the tow-cable for subsequent exercises.

9 Claims, 7 Drawing Figures

VERTICALLY ADJUSTABLE BOVINE ROPING PRACTICE APPARATUS

BACKGROUND OF THE INVENTION

Calf roping and steer roping, both major rodeo events, are sports pursued by many individuals.

Calf roping is an event in which a calf, released from a chute at one end of an arena, runs generally to the opposite side of the arena. A mounted roper pursues the calf and attempts to lasso the calf around the neck. When successful, the rider stops the calf, dismounts, throws the calf on its side, and ties three of the calves legs together with a rope. The winner of such a competition is the rider with the shortest time interval between the release of the calf, and the completion of the tying of the legs together.

Steer roping is an event in which a horned steer is released from a chute at one end of an arena, and runs generally to the opposite end of the arena. Two mounted ropers, the header and the heeler, give chase on either side of the steer. The header lassos the horns of the steer and "tows" the steer in a leftward circle. The heeler then lassos the hind legs of the steer. Both ropers then back their horses in opposite directions, causing the steer to drop and become immobile. The team with the shortest time interval between the release of the steer, and the immobilization of the steer is victorious.

To master the necessary skills requires a great deal of practice, both for the rider/roper and for the horse. This practice is best obtained by the repetitious pursuing and roping of the running animal. There are numerous burdens associated with the use of live animals for this purpose, however. The beasts must be corralled, controlled, fed and otherwise maintained. The practice area must be enclosed, and further problems may be encountered in the form of zoning or pollution regulations.

In an effort to avoid these problems, mechanical targets have been designed to substitute for the live animals. For examples of these earlier inventions, see McCord, U.S. Pat. No. 3,711,098 and Parsons, U.S. Pat. No. 3,974,799.

In view of the techniques involved, it becomes obvious that an apparatus appropriate for calf roping is not inherently suitable for steer roping. There is an important size variance between the two animals, and the horns of the steer would be obstructive to the practice of lassoing the calf by the neck. Further, a tow-cable release mechanism suitable for a calf roping apparatus may not be compatible with a steer roping apparatus.

SUMMARY OF THE INVENTION

In view of the given background, it may be seen that the instant invention relates generally to a roping/training apparatus and more particularly to a portable, mechanical apparatus that can simulate either a running calf or a running steer, thereby providing a target to be pursued and lassoed by a mounted roper or ropers.

It is an object of this invention to provide an improved apparatus for use in the training of calf and steer roping.

Another object of this invention is to provide an apparatus easily transformable from a calf to a steer and vice-versa.

Another object of this invention is to provide an apparatus offering both realistic steer roping and calf roping action.

A further object of this invention is to provide an apparatus containing one basic tow-cable release mechanism which is compatible for both calf and steer roping with only a minor alteration in the triggering mechanism.

Another object of this invention is to provide a mechanical roping/training apparatus which is economical to manufacture, durable of construction, and highly effective in use.

These and other objects are realized by a portable, mechanical apparatus that can simulate either a running calf or a running steer as a target towed by a cable, the target having an appropriate bovine appearance and structure, the body height and position of which may be so altered as to resemble either a calf or a steer. The apparatus further includes ground engaging elements, a release system that accomodates the roping techniques of both calf roping and steer roping, and is easily reconnected to the tow-cable for subsequent runs.

BRIEF DESCRIPTION OF THE DRAWINGS

The objects heretofore set forth and others become more readily apparent upon reference to the following description, especially when taken in conjunction with the appended drawings, described briefly as follows.

DESCRIPTION OF THE PREFERRED EMBODIMENT

Figure 1:
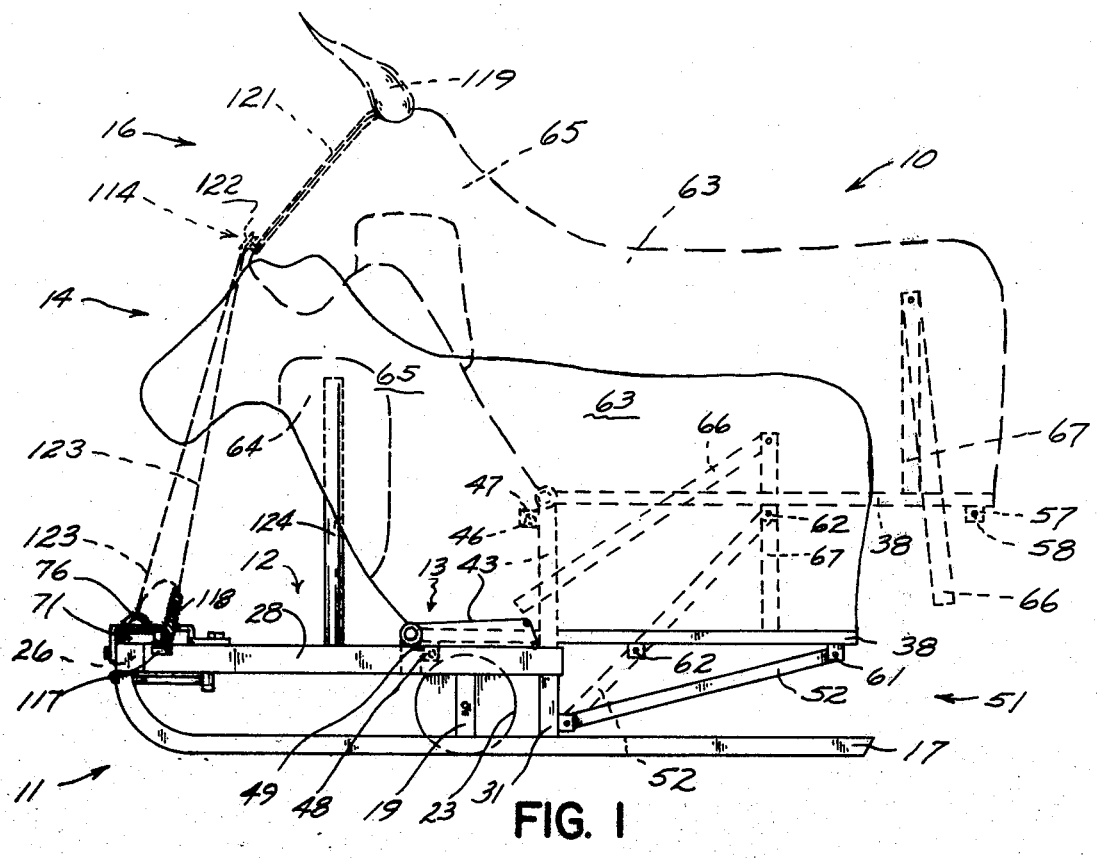
FIG. 1 is a front elevational view of the mechanical roping/training apparatus depicting the calf position in solid lines and the steer position by broken lines.

Referring now to the drawings, and in particular to FIG. 1, the Bovine Roping Practice apparatus of this invention is indicated generally by the numeral 10. The apparatus 10 includes a ground engaging structure 11, a first frame 12 secured to the ground engaging structure 11, and a second frame 13 pivotally connected to the first frame 12. The second frame is selectively movable with respect to the first frame between a calf position 14 (depicted in solid lines) or a steer position 16 (depicted by broken lines).

The ground engaging structure 11 (FIGS. 1 and 2) includes a pair of parallel sled-like runners 17 and 18 each having a forward end which arcs upwardly. Secured to and projecting upwardly from each runner is a vertical strut 19 and 21 respectively. An axle 22 is laterally disposed between the runners and secured on each end to the struts 19 and 21. Rotatably mounted on the axle are a pair of ground engaging wheels 23 and 24.

The first frame 12 (FIGS. 1 and 2) is horizontally disposed and includes four members 26, 27, 28 and 29 welded together to form an open rectangle box frame having parallel front and rear members 26 and 27 and parallel side members 28 and 29. Secured to and depending from the rear end of the first frame are a second pair of spaced struts 31 and 32 which are secured on their other end to the runners 17 and 18. The front member 26 is affixed to the forward end of the runners. Interconnecting the side members 28 and 29 and parallel with the front and rear members 26 and 27 is a cross bar 33. The cross bar not only provides strength to the front frame but also supports the second frame in a calf position.

The second frame 13 (FIGS. 1 and 2) includes four horizontally disposed members, two of which are parallel front 36 and rear 37 members and two are parallel side members 38 and 39 which are connected at their ends to the front and rear members to form a rectangular frame. A third longitudinal member 40 is disposed between the side members 38 and 39 and secured on its ends to the front and rear members 36 and 37. Secured to and projecting axially of both ends of the front member 36 are stub axles 41 and 42. Rotatably mounted on and depending from each stub axle is an arm 43 and 44 respectively. Each arm is pivotally connected on its depending end to the rear member 27 of the first frame 12 wherein the arms 43 and 44 are vertical when the second frame is in the steer position 16 and horizontal when in the calf position 14. In the calf position 14 the upper ends of the arms are disposed on the cross bar. Proximate the upper end of each arm and projecting forwardly thereof is a bracket 46 having an opening 47 formed therethrough. On the cross bar 33 are affixed a pair of spaced securing devices 48 for releaseable attachment by a pin 49 to the brackets 46 wherein the second frame can be locked in a calf position.

Figure 2:
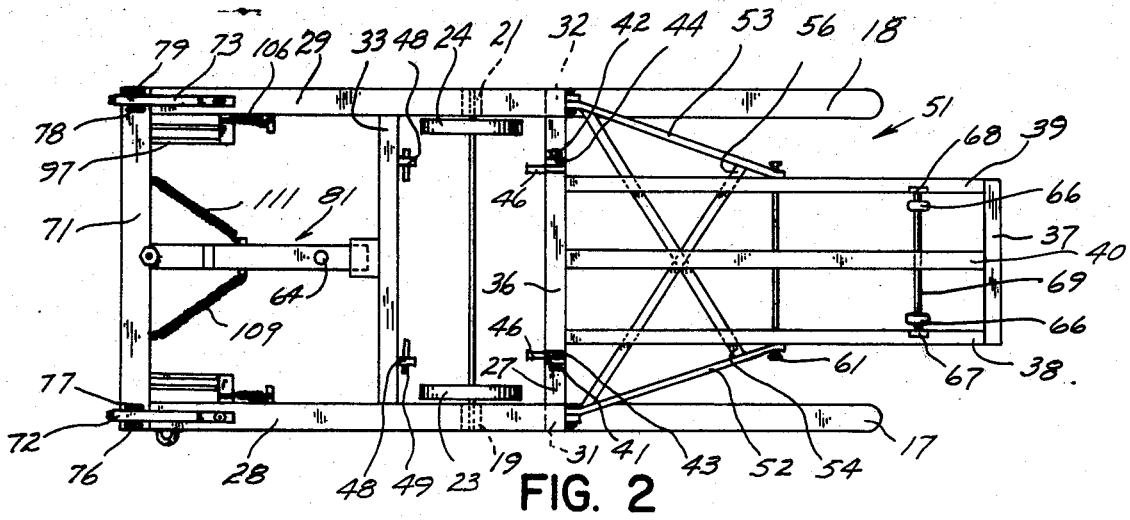
FIG. 2 is a top plan view of the apparatus with the bovine figure removed.
Figure 3:
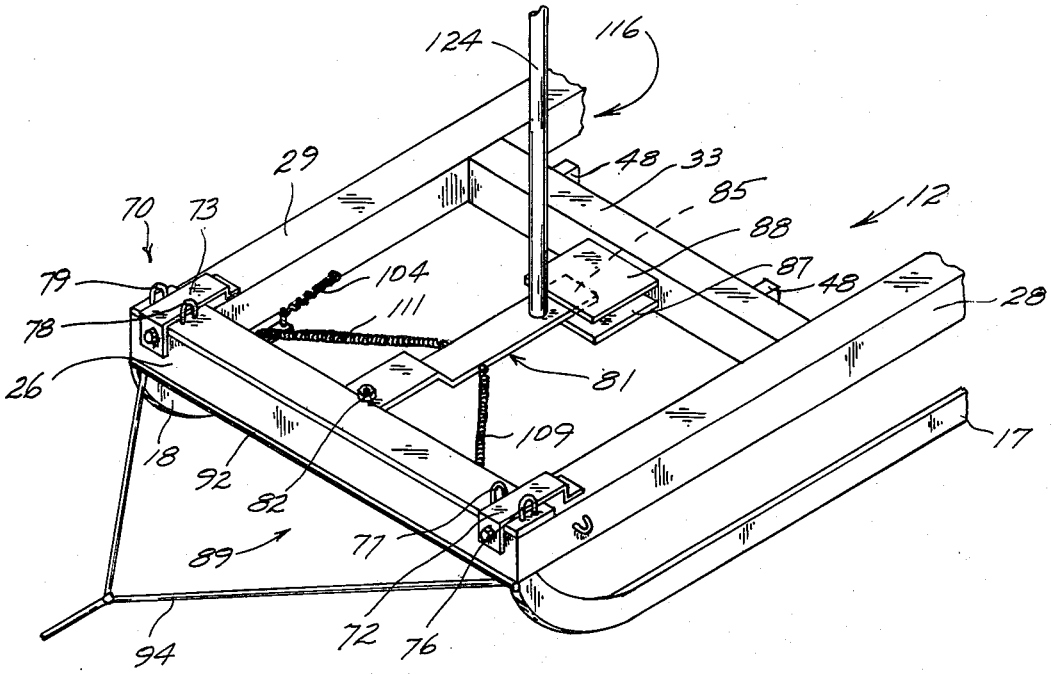
FIG. 3 is a perspective view of the front end of the apparatus with the bovine figure removed for the purposes of illustration.

Additional interrelational support between the two frames is provided by a linkage 51 (FIGS. 1 and 2). This linkage includes a pair of bars 52 and 53 pivotally secured on one end to the spaced struts 31 and 32 respectively and on the other end to the side members 38 and 39 respectively. Interconnecting the bars in an X shaped pattern are cross braces 54 and 56.

It may be observed in FIG. 1 that the side members 38 and 39 of the second frame 13 proximate the rear end thereof each have a bracket 57 connected to and depending therefrom and further each bracket has a hole 58 drilled therethrough. The linkage 51 is affixed to the second frame 13 by impaling the free ends of the two pivotable bars 52 and 53 with a removable pin 61, and further inserting that pin 61 through the holes 58 in the brackets 57. This is the proper position of the pivotable linkage 51 when the apparatus 10 is in the calf position 14.

It may be further observed that the side members 38 and 39 are also equipped with a second pair of depending brackets 62 similar to the brackets 57 described above, though located further forward on the side members 39 and 41. When the invention 10 is in the steer position 16, the linkage 51 is affixed to the second frame 13 by again utilizing pin 61, though now utilizing the second pair of brackets 62 rather than the first pair 57. FIG. 2 depicts the linkage 51 in the steer position.

Resting atop the second frame 13 and suitably connected thereto is a bovine figure 63, constructed of some appropriate material such as fiberglass. This bovine figure 63 is hollow, and includes a cutaway portion 64, in the neck 65 thereof.

The structural metamorphosis from the calf 14 to the steer 16 (FIGS. 1 and 2) may now be described as follows. The pins 49 restraining the two arms 43 and 44 in a horizontal position are removed. The pin 61 affixing the linkage 51 to the second frame 13 is also removed. The two arms 43 and 44 are then rotated in an upward and rearward fashion until vertically disposed. The second frame structure 13 has thus pivoted about the stub axles 41 and 42 thereby allowing it to remain horizontal. The linkage 51 is then pivoted upwardly until it can be pinned to the second frame 13 via the two brackets 62 connected thereto. When so connected, the second frame is supported and maintained in a horizontal plane. By this procedure, the bovine figure 63 is relegated to a higher position relative to the ground, and thereby imitates the body height of a steer.

The steer position disclosed also the means of providing hind legs 66 (FIGS. 1 and 2). Two vertically disposed posts 67 and 68 are attached to the second frame 13, and project upwardly therefrom into the hollow insides of the bovine figure 63. An axle 69 is supported between these two supports 67 and 68, which axle 69 then pivotably supports the pair of hind legs 66. The legs 66, as with the rest of the invention 10, may be made of any suitable material, such as metal or wood. It may be seen in FIG. 1 that in the steer position 16, the legs 66 hang down. In the calf position 14, the legs 66 may be propped up within the hollow insides of the bovine figure 63.

Referring now to FIGS. 3 through 7, a tow-cable release mechanism 70 is described and includes at the front end of the first frame 12, a tow-cable latch bar 71 disposed unattached on top of the front member 26 of the first frame 12. The tow-cable latch bar 71 spans the width of the front member 26, and is restrained against excessive forward, rearward or vertical motion by two guides 72 and 73. The guides are secured to each end of the front member 26 and are bent such that they may be bolted or otherwise affixed to the front end of the first frame 12, and on the top surface of the side members 28 and 29, respectively. Four eyelets 76, 77, 78 and 79 are located on the latch bar 71 to prevent the latch bar 71 from experiencing excessive lateral movement.

A rearwardly projecting member 81 (FIGS. 3 and 6) is permanently affixed to the rearward edge of the latch bar 71 by welding a nut 82 to both the member 81 and the latch bar 71, such that a bolt 83 may extend vertically downward behind the front member 26. The member 81 has a forward section 84, an inclined section 86 and a rear section 85 such that the rear section 88 ends proximate the leading edge of the lateral cross bar 33, and is held supported from underneath by a first flange 87 and restrained from above by a second flange 88. Both of the flanges 87 and 88 are connected to the cross bar 33 so as to lie substantially in parallel horizontal planes.

The latch bar 71, the member 81 and the bolt 83 form a T-bar structure 89, which is free to move to a certain limited extent in all directions parallel to the horizontal plane. The purpose of this limited freedom of motion will become apparent hereinafter.

A hinge 91 (FIGS. 5 and 6) is attached to the underside forward edge of the front member 26. A tow-cable release bar 92 is affixed to the hinge 91 wherein the release bar 92 has rotatable freedom of motion through an arc of approximately 270°. That is, the release bar is allowed to move from a position nearly parallel to the front edge of the front member to a position nearly parallel to the underside of the front member. The release bar spans substantially the entire length of the front member, leaving exposed space on the front member at either end thereof for the attachment of the sled-runners 17 and 18.

Figure 5:
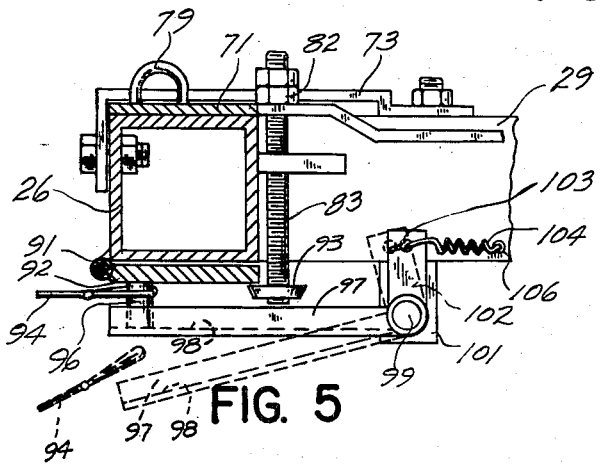
FIG. 5 is a partial cutaway side elevational view of the front end of the apparatus chassis, in the "latch" mode.

In FIG. 5, it may be observed that a flange 93 is attached to the lower end of the bolt 83. When the T-bar structure 89 is in its forward position (as shown in FIG. 5), and the release bar 92 is in juxtaposition with the underside of the front member 26, the flange 93 will prevent the release bar 92 from pivoting downward and forward. When the T-bar structure 89 is moved rearwardly to a new position (shown in FIG. 6), it may be seen that the flange 93 will be repositioned and will allow the release bar 92 pivotal freedom.

The following description of the tow-cable attachment and release mechanism for one side of the apparatus 10 will also serve as a description of the same mechanical structure and operations occuring on the side opposite.

Figure 7:
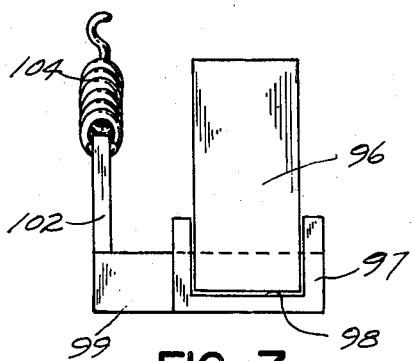
FIG. 7 is an enlarged partial front elevational view of one of the peg and guard arm structures.

As observed in FIG. 5, a tow-cable 94 is looped around a peg 96 that is attached to the release bar 92. The tow-cable 94 is prevented from slipping downward off the peg 96 by a guard-arm 97. As seen in FIG. 7, the guard-arm 97 has a rectangularly shaped longitudinal recess 98 for receiving the free end of the peg 96 therein. The guard-arm 97 is pivotably connected to a shaft 99 and the shaft 99 is affixed to a flange 101. The flange 101 is connected to the side member 28 or 29 and depends therefrom. Extending upwardly and perpendicularly to the guard-arm 97 and connected thereto is a tab 102. At its free end, the tab has a hole 103 therein sufficient to support and engage a spring 104, which spring 104 is affixed on its other end to the side member 28 by a peg 106. The spring 104 will bias the guard arm 97 thus preventing the tow-cable from slipping off of the peg 96.

Figure 4:
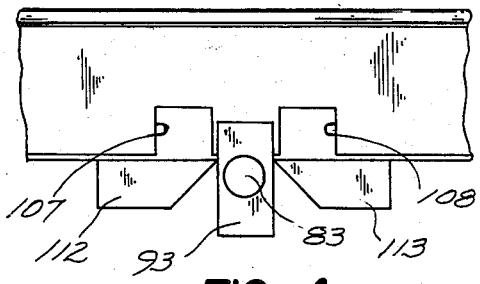
FIG. 4 is a partial bottom plan view of the tow-cable release bar.
Figure 6:
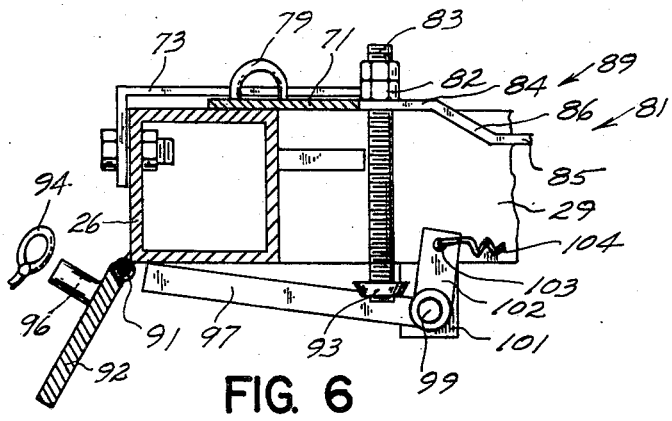
FIG. 6 is a partial cutaway side elevational view of the front end of the apparatus chassis, in the "release" mode.

Referring now to FIG. 4, it will be observed that the release bar 92 has two rectangularly shaped notches 107 and 108 cut therein on either side of where the flange 93 engages the release bar 92 (FIG. 5). The flange 93 is maintained in a latch position during normal operation of the apparatus 10 by two springs 109 and 111 (FIG. 3) and by two centering guides 112 and 113 (FIG. 4). One end of the springs 109 and 111 is attached to the side of the member 81 and the opposite end is connected to the front member 26. These springs prevent the T-bar structure 89 from making unwarranted rearward motions due to the disturbances experienced by this structure when being towed. The two centering guides 112 and 113 are also affixed to the front member 26 on opposite sides of the bolt 83. These guides act to prevent the T-bar structure 89 from making unwanted lateral movements while the apparatus is being towed. When the T-bar structure 89 is moved sideways in response to the proper stimuli, the flange 93 will slip through the notched elements 107 or 108, allowing the release bar 89 to rotate downwardly and forward.

Two triggering mechanisms 114 and 116 must operate to move the T-bar structure 89 so as to allow the release bar 92 to rotate as described above and thereby release the tow-cable 94, the steer trigger mechanism 114 and the calf trigger mechanism 116 function somewhat differently to accomodate the two styles of roping involved.

Referring again to FIG. 1, the steer trigger mechanism 114 may be described as follows. An eyelet 117 is connected to the forward exterior vertical side of the side member 26 of the first frame 12. A spring 118 is connected on one end to the eyelet 117. A pair of horns 119, used only when the apparatus 10 is in the steer mode 16, are connected to a section of pipe 121, or the like, which combination of pipe 121 and horns 119 is then placed in a notched recess provided therefor in the head of the apparatus 10. At the end of pipe 121 opposite the end attached to the horns 119 is a pulley 122. A trigger cord 123 is disposed through said pulley 122 with one end of the trigger cord 123 attached to eyelet 79 (FIG. 2) and the opposite end attached to eyelet 76. As observed in FIG. 1, the end of the cord 123 that is attached to eyelet 76 is also attached a few inches above the eyelet 76 attachment to the spring 118. This spring 118 serves a dual role. First, it buffers the trigger cord 123 against the usual jolts that occur when the apparatus is moved about in use. Secondly, the cord 123 exerts a downward pull on the pipe 121 and horns 119 assembly, thereby maintaining that assembly in place upon the head.

When a lariat tightens about the horns 119, the force exerted thereby will overcome the retention forces stemming from the spring 118, and the pipe 121 and horns 119 assembly will be removed from the head. This movement will be sufficient to cause the trigger cord 123 to move the T-bar structure 89 and thereby effectuate the release of the tow-cable 94.

The calf trigger mechanism 116 is comprised of a vertical trigger bar 124 attached to the T-bar structure 89 such that the uppermost end thereof extends into the cutaway portion 64 in the neck of the bovine figure 63. A lariat tightening about the body, a four-legged catch, will cause the trigger bar 124 to experience a rearward force, this causing the trigger bar to move rearwardly and taking the T-bar structure 89 along with it. This movement causes the release mechanism to operate as described above and the tow-cable 94 to be released.

The preferred method of roping a calf however, is around the neck and in the present invention neither triggering mechanism is engaged. The method of disengagement of the tow-cable 94 from the peg 96 is described hereinafter.

The operation of the apparatus 10 in the calf mode 14 may now be described as follows. The apparatus 10 is located opposite some towing mechanism, such as a motorized retrieval system, and with the tow-cable 94 attached. The roper waits mounted on one side of the apparatus 10. The towing mechanism is activated and the apparatus 10 begins to move towards the towing mechanism. The roper pursues the apparatus 10 and attempts to lasso the calf 14 around the neck. If successful, the effect of the taut lariat around the neck will cause the apparatus to tilt rearwardly on its runners, thus causing the tow-cable 94 to engage the guard arm 97 and to cause the guard arm to pivot against the bias of the spring 104 which results in the release of the tow-cable 94 from the peg 96. The apparatus 10 ceases forward motion and the exercise is completed. (Greater realism may be achieved by requiring the roper to dismount, and touch the apparatus 10 or activate a horn on it, to simulate the dismounting and tying aspects of the sport).

It is also possible to obtain a four legged catch in the calf mode wherein the lariat completely encircles the bovine figure. The lariat upon becoming taut engages the trigger bar 124 and causes the tow-cable to be released as hereinabove described.

The operation of the apparatus 10 in the steer mode 16 may similarly be described as follows. The apparatus 10 is placed opposite an appropriate towing mechanism. The apparatus 10 is affixed in the steer mode 16, with the steer trigger mechanism 114 in place, the rear legs 66 exposed, and the tow-cable 94 connected. Two riders, a header and a heeler are located on opposite sides of the apparatus 10. When the towing mechanism is activated, the apparatus 10 moves forward, pursued by the riders. The header attempts to rope the steer's horns 119, and when successful, the tightenting lariat removes the pipe 121 and horns 119 assembly, resulting in the release of the tow-cable 94. After the tow cable 94 is released, the header tows the apparatus 10 in a leftward arc, while the heeler lassos the rear legs 66 to complete the exercise.

It is a further feature of this apparatus 10 that if the header succeeds in roping only one horn, the rope will slip off without allowing a towing action. Since in the real sport a one-horned catch is illegal, this aspect of the apparatus adds a further note of realism by imposing such a functional penalty.

It should be obvious that either the calf or steer roping exercise may be repeated by returning the apparatus 10 to its starting point, returning the release bar 92 and the T-bar structure 89 to the latch position, and then reconnecting the tow-cable 94 to the connecting pegs 96.

I claim:

1. A bovine roping practice apparatus comprising:

(a) a ground engaging means for translational movement along the ground;

(b) a super structure connected to said ground engaging means and selectively movable vertically between a stable first and a stable second position, means to secure said super structure in said first and second positions; wherein said first position approximates the height and appearance of a calf suitable for practicing the roping of calves, and said second position approximates the height and appearance of a steer, said super structure in said second position having rearward legs approximating the legs of a steer with downwardly disposed free ends, which free ends are also disposed substantially free of the apparatus and above the ground suitable for practicing the roping of steers; and (c) a tow-cable means releaseably connected to said super structure for towing said apparatus along the ground.

2. A bovine roping practice apparatus as defined in claim 1 wherein said superstructure includes a first frame secured to said ground engaging means and connected to said tow-cable means; a second frame pivotally connected to said first frame; said second frame selectively movable between said first position and said second position; and means to selectively secure said second frame in said first position and said second position, respectively.

3. A bovine roping practice apparatus as defined in claim 2 and said superstructure includes a bovine like structure secured to said second frame.

4. A bovine roping practice apparatus as defined in claim 3 and said tow-cable means including a bar means disposed on said first frame; at least one guide secured to said first frame and coactable with said bar means to restrain said bar means from excessive movement said bar means movable from a normal position to a release position; a release bar hingedly connected to said first frame for movement from a latch position to a release position; latching means mounted on said bar means and coactable with said release bar; trigger means secured to said bar means for moving said bar means from said normal position to said release position; and a tow-cable secured to said release bar in said latch position and releaseably secured to said release bar in said release position.

5. A bovine roping practice apparatus as defined in claim 4 and said trigger means including a pair of horns removably mounted on said bovine like structure; a pulley means attached to said horns; and a trigger cord operably disposed about said pulley and attached to said bar means wherein movement of said cord moves said bar means from said normal position to said release position.

6. A bovine roping practice apparatus as defined in claim 4 and said trigger means including an upright trigger secured to said bar means wherein movement of said trigger moves said bar means from said normal position to said release position.

7. A bovine roping practice apparatus as defined in claim 6 and said trigger means includes a spring for biasing said bar means to said normal position.

8. A bovine roping practice apparatus as defined in claim 7 including a guard arm pivotally secured to said first frame and coactable with said release bar to restrain said release bar in said latch position; and a second spring interconnected between said guard arm and said first frame to bias said release bar to said latch position.

9. A bovine roping practice apparatus as defined in claim 8 and said bar means includes a latch bar disposed on said first frame a member having one end secured to latch bar and a free end projecting rearwardly therefrom, parallel flanges secured to said frame means and coactable with said member free end to restrict vertical movement of said member, said trigger having one end secured to said member and having another end coactable with said bovine like structure.

* * * * *